United States Patent [19]

Key et al.

[11] 4,390,815

[45] Jun. 28, 1983

[54] APPARATUS FOR INFLUENCING ELECTRON BEAM MOVEMENT

[75] Inventors: Charles W. Key, Bloomington; Edward W. Christensen, II, Indianapolis, both of Ind.

[73] Assignee: RCA Corporation, New York, N.Y.

[21] Appl. No.: 244,664

[22] Filed: Mar. 17, 1981

[51] Int. Cl.[3] ..... H01J 29/70; H01J 29/76

[52] U.S. Cl. ..... 315/368; 358/10; 335/210

[58] Field of Search ..... 315/368, 13 C; 358/10; 335/210, 212, 213

[56] References Cited

U.S. PATENT DOCUMENTS

| | | | |
|---|---|---|---|
| 4,105,983 | 8/1978 | Barten et al. | 335/212 |
| 4,138,628 | 2/1979 | Smith | 315/368 |
| 4,159,456 | 6/1979 | Smith | 335/210 |
| 4,162,470 | 7/1979 | Smith | 335/210 |
| 4,189,659 | 2/1980 | Andre et al. | 313/412 |
| 4,211,960 | 7/1980 | Barten et al. | 315/368 |

*Primary Examiner*—Theodore M. Blum

*Attorney, Agent, or Firm*—Eugene M. Whitacre; Paul J. Rasmussen; Scott J. Stevens

[57] ABSTRACT

An apparatus for influencing the movement of electron beams of a cathode ray tube comprises means for magnetizing a strip of magnetizable material disposed about the neck of the tube. The magnetizing means includes a pair of members each incorporating magnetizing coils. Means including a hinge is coupled to the members for providing a first opened position of the members for placing the magnetization on the tube neck and a second closed position of the members for encircling the tube neck. A source of magnetizing current is coupled to the magnetizing coils for developing magnetic fields in the vicinity of the coils for magnetizing the magnetizable strip.

10 Claims, 6 Drawing Figures

APPARATUS FOR INFLUENCING ELECTRON BEAM MOVEMENT

This invention relates to apparatus for influencing electron beam motion via magnetic fields to provide color purity and static convergence correction, and in particular, to apparatus for creating the correcting magnetic fields.

During the manufacturing of cathode ray tubes for color television receivers, the location of the color-producing phosphor elements is determined by exposing photosensitive material on the tube face to focused beams of light which approximate the paths of the tubes' electron beams. The exposed areas on the tube face then become the sites for the color phosphor elements. With the manufacture of some tubes, this process is repeated for each of the three color-producing phosphors.

Although the light-electron beam approximation is quite good, the electron beams, consisting of streams of charged particles, are not influenced in the same way as are beams of light, which may cause mislanding of the electron beams with respect to the location of the phosphor elements on the display screen. Such beam mislanding results in a degradation of color purity which may be corrected by the placement and proper adjustment of a suitable magnetic field at the rear of the deflection yoke in the vicinity of the tube electron gun assembly. In the past this field has often been produced by a pair of two-pole magnetic rings which may be rotated to vary the strength and orientation of the resulting magnetic field.

Color television receivers may achieve convergence of the electron beams as they are scanned across the raster by dynamic convergence circuitry or by the use of self-converging deflection yokes for use with color television kinescopes having three horizontally aligned electron beams, which can substantially converge the electron beams at all points on the scanned raster without the need for dynamic convergence circuitry. Irregularities or tolerances in the manufacture of the kinescope, and deflection yoke, however, may result in the misconvergence of the electron beams at the center of the kinescope display screen without any deflection of the beams. This initial misconvergence is not tolerable with either a self-converging tube-yoke combination, or one which requires dynamic convergence and it has become common practice to provide a static convergence device disposed at the rear of the yoke to provide convergence of the beams under undeflected conditions. A device for achieving static convergence for use with an in-line kinescope is disclosed in U.S. Pat. No. 3,725,831—Barbin, which illustrates the use of a pair of four-pole magnetic rings together with a pair of six-pole magnetic rings to establish magnetic fields of appropriate strength and orientation to move the individual electron beams appropriately in order to achieve center static convergence of the beams. It is possible, as disclosed in U.S. Pat. No. 3,725,831, to combine the two-pole purity rings with the four and six-pole static convergence rings to form a single "beam bender" device.

The discrete multi-ringed purity and static convergence device previously described, although achieving the desired electron beam corrective movement, adds to the receiver cost both in terms of the cost of the device itself and the time required by an operator in adjusting the position of the individual rings. Ring adjustment may be accomplished by an operator physically moving the rings or mechanically such as through the use of a yoke adjustment machine, which rotates the rings via motor-driven gears or wheels. In addition to the cost aspects previously mentioned, the use of discrete beam bender devices requires some means for securely locking the rings in place, once the proper ring position is achieved, so that the ring positions will not change in the event the tube or receiver is moved or disturbed.

The same purity and static convergence control was accomplished by the subsequent development of the sheath or strip beam bender, such as disclosed in U.S. Pat. No. 4,211,960—Barten et al. The sheath beam bender comprises a strip of magnetizable material such as barium ferrite located adjacent to the neck of the tube at the rear of the yoke. A device, incorporating magnetizing coils, is placed over the strip and current through the coils is adjusted until beam purity and/or static convergence is achieved. The magnetic field in the vicinity of the magnetizing coils magnetizes the strip in regions roughly corresponding to the locations of the magnetic poles of the ring-type beam bender. When the magnetizing device is removed the strip remains magnetized and maintains the desired beam correction.

One difficulty encountered in the use of the aforementioned sheath beam bender arises because of the construction of the magnetizing head or device. The magnetizing coils are desirably located close to the magnetizable strip, resulting in the interior surface of the magnetizing device conforming to the neck of the tube. This may cause problems in placing the magnetizing device on or removing it from the neck of the tube when, for example, the purity and static convergence correction is done on a continuous receiver or tube assembly line with the tube desirably energized for an extended period of time. In order to place the close fitting magnetizing device on the tube, it may be necessary to remove the tube energizing socket, which allows the tube to cool somewhat, thereby necessitating waiting for the tube to reheat when the socket is replaced. This increases the time necessary to perform the correction steps. Additionally, the socket must also be temporarily removed to take the magnetizing device off the tube neck resulting again in the aforementioned cooling and reheating problem further increasing overall assembly time. The cost saving of the sheath beam bender over the ring-type device is therefore not fully realized as a result of the increased tube or receiver assembly time.

The present invention provides a means for magnetizing a sheath-type beam bender to achieve beam purity and/or static convergence correction without requiring the removal of the tube-energizing socket in order to position the magnetizing device.

In accordance with the present invention an apparatus for influencing the movement of electron beams in a cathode ray tube comprises a magnetizing means for magnetizing a strip of magnetizable material disposed about the neck of the tube. Means are provided for magnetizing the strip to produce permanently magnetized regions on the strip for influencing the movement of the electron beams. The magnetizing means comprises a first member incorporating first magnetizing coils and a second member incorporating second magnetizing coils coupled to said first coils.

Means are coupled to said first and second arm members for selectively providing a first opened position of the members for enabling placement of the magnetizing means on the tube neck and a second closed position of the members with the magnetizing means encircling the tube neck. Means couple a source of magnetizing current to the first and second magnetizing coils for developing magnetic fields in the vicinity of the magnetizing coils for magnetizing the magnetizable strip.

In the accompanying drawing, FIG. 1 is a perspective view of a television display system used in cooperation with the present invention;

Figure 1:
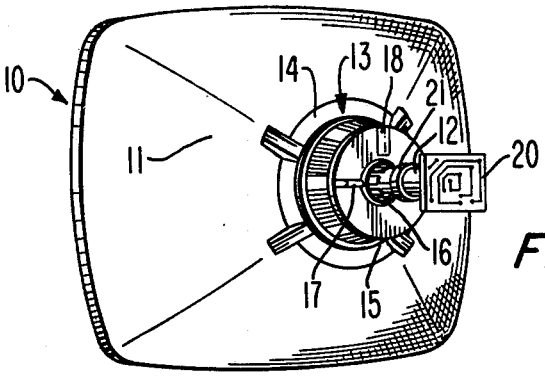

Referring to FIG. 1, there is shown a television display system comprising a kinescope 10 having a funnel region 11 and a neck 12. A deflection yoke 13 is located on kinescope 10 and is mounted to the funnel region 11 at the front of yoke 13, for example, via mounting ring 14 and to the neck 12 via a clamp (not shown). A rear mounting plate 15 incorporates fingers 16 which cooperate with the rear yoke clamp. Mounting plate 15 also incorporates raised ridge members 17 and 18, whose function will be described later. Means, such as printed circuit board 20, are mounted to kinescope 10 via a kinescope socket (not shown). Circuit board 20 may include kinescope driver or energization circuitry for operating the electron gun assembly disposed within the neck 12 of kinescope 10. Input signals to circuit board 20 and horizontal and vertical deflection signals to yoke 13 are produced by appropriate circuits (not shown) incorporated, for example, in a television receiver or a kinescope display system test apparatus.

A strip 21 of magnetizable material is disposed about the neck 12 of kinescope 10 at the rear of yoke 13 in the vicinity of the electron gun assembly. Strip 21, when properly magnetized, provides purity and static convergence correction for the electron beams produced by the electron gun assembly of kinescope 10. It is obvious that in order to magnetize strip 21 by using a closed ring magnetizer such as shown in U.S. Pat. No. 4,211,960, it would require that circuit board 20 be removed once in order to place the magnetizer in position adjacent to strip 21 and again in order to remove the magnetizer. Each time that circuit board 20 is removed, operation of kinescope 10 is interrupted, causing kinescope 10 to cool somewhat, thereby requiring additional time to reheat before further tests or adjustments can be made.

Figure 2:
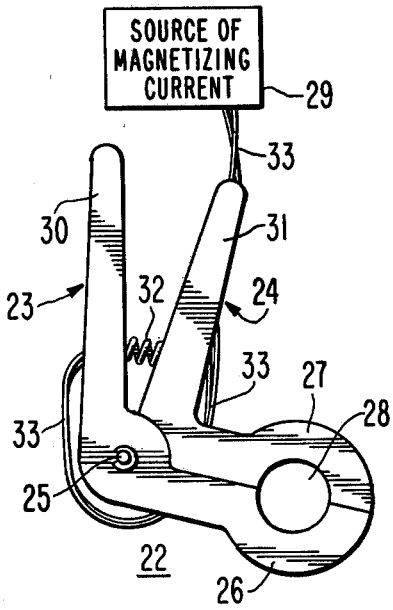
FIG. 2 is a front elevational view of a magnetizing means in accordance with an element of the present invention.

FIG. 2 illustrates a magnetizing apparatus 22 which is easily placed on or taken off kinescope neck 12 without removing circuit board 20. Magnetizing apparatus 22 comprises members 23 and 24 which are coupled together by means including a hinge arrangement comprising a hinge pin 25. One end of each of members 23 and 24 has a semi-circular portion 26 and 27, respectively, which cooperate to form a circular aperture 28 when portions 26 and 27 are in contact. Aperture 28 is dimensioned to encircle the neck 12 of kinescope 10 around the magnetizable strip 21. The other ends of members 23 and 24 form handles 30 and 31 which are separated by a spring 32. Spring 32 tends to force handles 30 and 31 apart, thereby keeping semi-circular portions 26 and 27 in contact and maintaining magnetizing apparatus 22 in a closed position. Coils of wire for establishing magnetic fields in order to magnetize regions of strip 21 to achieve purity and convergence correction are located within hollow channels formed in semi-circular portions 26 and 27. Wires 33 provide current to these coils from a source of magnetizing current 29, which is adjustable to provide the desired amount of correction.

Figure 3:
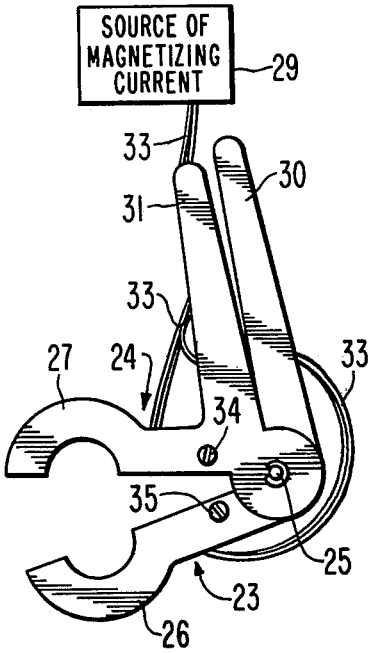
FIG. 3 is a rear elevational view of the magnetizing means of FIG. 2.

When handles 30 and 31 are squeezed together, members 23 and 24 pivot about hinge 25, forcing semi-circular portions 26 and 27 apart, placing magnetizing apparatus 22 into an opened position (as shown in FIG. 3). The spacing between portions 26 and 27 is then great enough to permit the kinescope neck 12 to pass between them. When the handles 30 and 31 are released, spring 32 forces the handles apart, bringing portions 26 and 27 back into contact, with the kinescope neck 12 located within aperture 28. Magnetizing apparatus 22 is therefore able to be placed on and removed from neck 12 without disturbing circuit board 20.

The radial orientation of the magnetizing coils of magnetizing apparatus 22 with respect to strip 21 is important in order to accurately correct purity and static convergence errors of kinescopic 10. To maintain a known coil orientation on a tube-to-tube basis, magnetizing apparatus 22 comprises alignment posts 34 and 35, shown in FIG. 3, which extend outwardly from members 23 and 24, respectively. When magnetizing apparatus 22 is in its closed position, and located on neck 12 in position for magnetizing strip 21, posts 34 and 35 lie on either side of one of ridges 17 or 18 on yoke mounting plate 15. The spacing between posts 34 and 35 when portions 26 and 27 are in contact is such as to cause posts 34 and 35 to fit snugly against ridge 17 or 18. This assures that the radial orientation of magnetizing apparatus 22, and hence the internal magnetizing coils, with respect to strip 21 is reproducible from tube to tube. The radial orientation of ridges 17 and 18 is also necessarily accurate from tube to tube.

Figure 4:
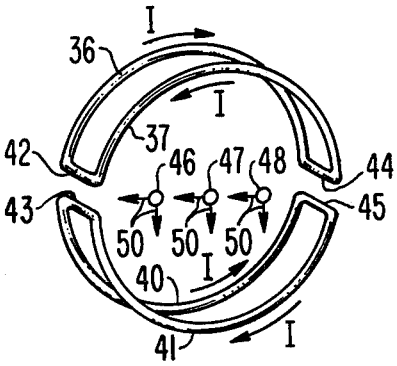
FIG. 4 illustrates the theory of operation of the magnetizing means of FIG. 2.

The magnetizing apparatus 22 of FIGS. 2 and 3 may be adapted, for example, for correcting color purity. In this application, portions 26 and 27 open along the kinescope horizontal axis, and posts 34 and 35 cooperate with ridge 17 to provide proper radial orientation. Color purity correction is obtained by creating permanently magnetized regions of appropriate polarity and pole strength in strip 21. These regions produce a color purity magnetic field within the interior of kinescope neck 12 for moving the three in-line electron beams. To create the magnetized regions in strip 21 four conductor wires 36, 37, 40 and 41, shown in FIG. 4, are imbedded near the inner surface of semi-circular portions 26 and 27 and shaped to extend tangential to the circumference of neck 12. End turn wires 42, 43, 44 and 45, represent connecting and terminal wires, which are coupled to a source of magnetizing current, such as source 29, of a selectable polarity, magnitude and duration for creating the appropriate magnetized regions in strip 21. For example, if the magnetizing current is selected so as to generate a current I in conductors 36, 37, 40 and 41 in a direction shown by the arrows in FIG. 4, the effect on electron beams 46, 47 and 48 is to move the beams as indicated by arrows 50 in FIG. 4. A more detailed description of the nature of operation of such a color parity corrector including the operation of magnetizing current source 29 can be found in U.S. Pat. No. 4,159,456—Smith.

In addition to color purity correction it is necessary to provide static convergence of the electron beams at the center of the kinescope display screen. This is commonly done through the use of the conjunction of a four-pole and six-pole magnetic field, which provides sufficient control over the beams to permit them to be converged.

Figure 5:
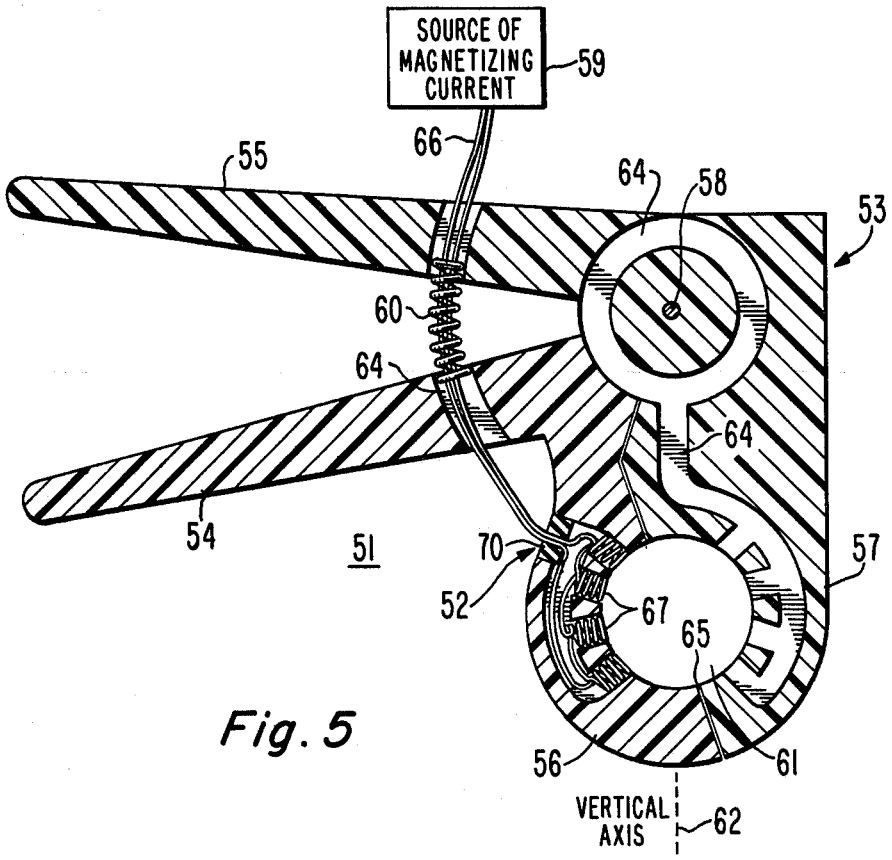
FIG. 5 is a cross sectional front elevational view of a magnetizing means similar to that shown in FIG. 2.
Figure 6:
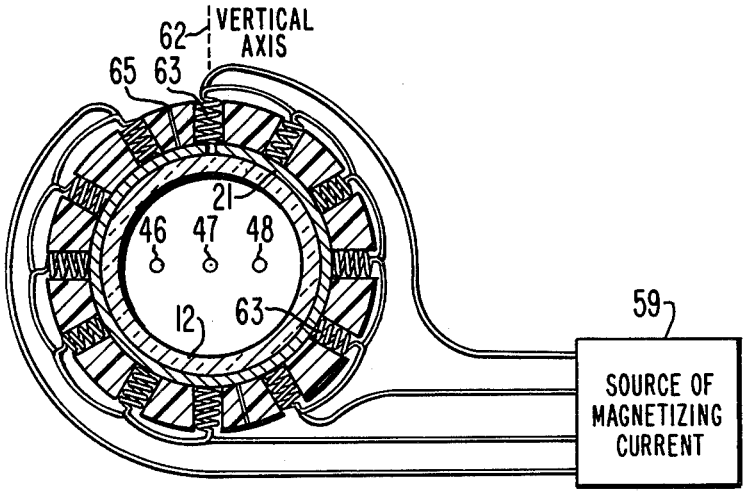
FIG. 6 illustrates the theory of operation of one aspect of the magnetizing means shown in FIG. 5.

FIG. 5 illustrates, in cross section, a magnetizing apparatus 51 for magnetizing strip 21 to provide static convergence of electron beams 46, 47 and 48 of kinescope 10. Magnetizing apparatus 51 is similar to magnetizing apparatus 22 shown in FIGS. 2 and 3, and comprises members 52 and 53, having handle portions 54 and 55, respectively, and semi-circular portions 56 and 57, respectively. Members 52 and 53 are coupled via a hinge 58. A spring 60 normally biases handles 54 and 55 apart, keeping portions 56 and 57 in contact, forming a tube-neck aperture 61. Also, shown in FIG. 5 are channels 64 formed in portions 56 and 57 for receiving magnetizing coils 67 and wires 66 for coupling coils 67 to a source of magnetizing current 59. Also shown is a strain relief 70, which provides support for wires 66 to prevent premature wire breakage during operation. For clarity of illustration, coils 67 and wires 66 are shown in portion 56 only. It is understood that corresponding coils, along with the necessary connecting wires and strain relief are present in portion 57 also. FIG. 5 illustrates the channel orientation with respect to the kinescope vertical axis 62 for establishing a four-pole magnetic field. Channels for establishing the cooperating six-pole magnetic field are located in a different cross sectional plane of magnetizing apparatus 51. The orientation of the coils 63 for the six-pole field is shown in FIG. 6. Wires 71 connecting coils 63 to the magnetizing current source 59 are also shown. The relationship to the kinescope vertical axis 62 is also shown. Particular magnetic pole arrangements for providing the purity and convergence correction magnetic fields have been described. It is to be understood that any suitable magnetic pole arrangement providing the equivalent functional correction, such as disclosed in the aforementioned U.S. Pat. No. 4,211,960 to Barten et al., may be utilized as well.

FIG. 5 also shows channels 64 through apparatus 51 which allow passage of wires connecting the magnetizing coils with the source of magnetizing current. The theory of operation of magnetizing apparatus 51 in achieving static convergence of the kinescope electron beams is known and is described in U.S. Pat. No. 4,162,470—Smith. Magnetizing apparatus 51 also incorporates radial alignment posts (not shown) which operate in a manner identical with posts 34 and 35 of apparatus 22.

It can be seen in FIGS. 5 and 6 that the contact plane 65 between semi-circular portions 56 or 57 is not aligned with the kinescope vertical axis 62. This offset permits the placement of magnetizing coils 63 in alignment with vertical axis 62, as shown in FIG. 6, without interference. It is obvious that as long as the proper orientation of the magnetizing coils is maintained, the design of the magnetizing apparatus 22 and 51 is flexible. It is also possible to combine the purity correction of apparatus 22 into one unit with static convergence apparatus 51, if desired.

What is claimed is:

1. Apparatus for influencing movement of electron beams in a cathode ray tube, comprising:

means for magnetizing a strip of magnetizable material disposed about the neck of said tube to produce permanently magnetized regions on said strip for influencing the movement of said beams, comprising:

a first member incorporating first magnetizing coils;

a second member separate from said first member and incorporating second magnetizing coils coupled to said first coils;

means coupled to said first and second members for selectively providing a first opened position of said members for placing said magnetizing means on said tube neck from a position substantially perpendicular to said tube neck and a second closed position of said members with said magnetizing means encircling said neck;

a source of magnetizing current; and means coupling said source of magnetizing current to said first and second magnetizing coils for developing magnetic fields in the vicinity of said coils for magnetizing said magnetizable strip.

2. The arrangement defined in claim 1, wherein said first and second members each comprises a semi-circular neck-encircling portion and a handle portion.

3. The arrangement defined in claim 1, wherein said means for selectively providing first and second positions of said members comprises a hinge.

4. The arrangement defined in claim 3, further comprising biasing means coupled to said members for normally maintaining said members in said second closed position.

5. The arrangement defined in claim 4, wherein said biasing means comprises a spring.

6. The arrangement defined in claim 1, wherein said members comprise indexing means adapted to cooperate with said cathode ray tube for providing a predetermined radial orientation of said coils with respect to said tube neck.

7. The arrangement defined in claim 1, wherein said magnetizing coils establish a two-pole magnetic field in said strip.

8. The arrangement defined in claim 1, wherein said coils establish a four-pole and a six-pole magnetic field in said strip.

9. A method for influencing movement of electron beams in a cathode ray tube, comprising the steps of:

placing a strip of magnetizable material about the neck of said tube;

placing a magnetizing apparatus about said tube neck adjacent said strip from a position substantially perpendicular to said tube neck, said apparatus comprising:

a first member incorporating first magnetizing coils;

a second member incorporating second magnetizing coils coupled to said first coils;

means coupled to said first and second members for selectively providing a first opened position of said members for placing said magnetizing means on said tube neck and a second closed position of said members with said magnetizing means encircling said tube neck;

providing a source of magnetizing current; and coupling said source of magnetizing current to said first and second magnetizing coils for developing magnetic fields in the vicinity of said coils for magnetizing said magnetizable strip.

10. A method for influencing movement of electron beams in a cathode ray tube, comprising the steps of:

placing a strip of magnetizable material about the neck of said tube;

opening a magnetizing apparatus comprising:

a first member incorporating first magnetizing coils;

a second member incorporating second magnetizing coils coupled to said first coils; and hinge means coupling said first and second members such that said first and second members pivot with respect to each other about said hinge means;

placing said magnetizing apparatus about said tube neck;

closing said apparatus such that said first and second magnetizing coils are adjacent said magnetizable strip; and coupling a source of magnetizing current to said first and second magnetizing coils for developing magnetic fields in the vicinity of said coils for magnetizing said magnetizable strip.

* * * * *